US007036307B2

(12) United States Patent
Rehkemper et al.

(10) Patent No.: US 7,036,307 B2
(45) Date of Patent: May 2, 2006

(54) RECHARGEABLE PNEUMATIC POWER SUPPLY

(75) Inventors: Jeffrey Rehkemper, Chicago, IL (US); Ryan Kratz, Chicago, IL (US); Charles Hartlaub, Glendale Heights, IL (US)

(73) Assignee: Rehco, LLC, Chicago, IL (US)

( * ) Notice: Subject to any disclaimer, the term of this patent is extended or adjusted under 35 U.S.C. 154(b) by 557 days.

(21) Appl. No.: 10/370,992

(22) Filed: Feb. 24, 2003

(65) Prior Publication Data

US 2004/0163385 A1 Aug. 26, 2004

(51) Int. Cl.
*F16D 31/02* (2006.01)

(52) U.S. Cl. ..... 60/413; 91/5

(58) Field of Classification Search ..... 60/413, 60/415; 91/5; 446/180
See application file for complete search history.

(56) References Cited

U.S. PATENT DOCUMENTS 1,347,805 A 7/1920 Feagan
2,695,601 A * 11/1954 Huber ..... 123/46 R
2,934,085 A 4/1960 Mylander
3,379,008 A 4/1968 Manganaro ..... 180/302
3,704,760 A 12/1972 Maruyama ..... 180/66
4,171,618 A 10/1979 Aegerter
4,329,806 A * 5/1982 Akiyama et al. ..... 446/180
4,730,999 A 3/1988 Tsukuda et al.
5,499,940 A * 3/1996 Johnson et al. ..... 446/180
6,006,519 A * 12/1999 Hormell, Jr. ..... 60/407
6,398,613 B1 * 6/2002 Rehkemper et al. ..... 446/197
6,508,324 B1 * 1/2003 Conley, Jr. ..... 180/165

* cited by examiner

*Primary Examiner*—Thomas E. Lazo

(57) ABSTRACT

In one embodiment, a pneumatic power-supply assembly includes a refillable chamber having an interior capable for holding a pressurized fluid, a vent, and a fluid inlet. A pressure release mechanism within the chamber permits the pressure within the chamber to vent, when the pressure exceeds a predetermined optimum pressure. A pneumatic motor is mounted within the chamber and includes an inlet in fluid communication with the interior of the chamber. The pneumatic motor utilizes the pressurized fluid within the interior of the chamber to drive a gear rotatably attached to the pneumatic motor. In addition, the gear rotates an axle rotatably attached to the chamber such that the when the assembly is attached to a pneumatic operated device the rotatable axle may be used by the pneumatically operated device. In addition, a external pump is attached to the fluid inlet to continually recharge the chamber.

18 Claims, 11 Drawing Sheets

220
226
228
228

44
224
234
228
232
236
230
46
228
222
212
226

44
224
220
232
230
236
224
228
210
46
234
228
222
212

RECHARGEABLE PNEUMATIC POWER SUPPLY

FIELD OF THE INVENTION

The present invention relates to pneumatic operated devices and more particularly to a rechargeable pneumatic power supply that is used to operate such devices.

BACKGROUND OF THE INVENTION

Pneumatic operated devices are well known in the prior art and are used in a wide variety of applications and fields. Pneumatic engines are also capable of replacing most electric powered or battery powered engines. Various problems however, exist in prior art pneumatic operated devices that are realized and solved by the present invention, such as size limitations, simplicity, and efficiency.

A typical prior art pneumatic operated device, such as a toy car, requires at the very least a reservoir to hold a pressurized fluid and a pneumatic motor or mechanism, for example, see U.S. Pat. No. 4,329,806 to Akiyama. However, a prior art pneumatic power supply requires complicated intake and exhaust manifolds between the pneumatic engine and reservoir, for example, see U.S. Pat. No. 6,006,517 to Kowanacki. In addition, some pneumatic operated devices include refillable reservoirs that incorporate complicated pressure release valves to vent excessive pressure inside the reservoir, also illustrated in U.S. Pat. No. 4,329,806. All of the above complicates the manufacturing of the pneumatic power supply and increases the likelihood that an individual part will break making the device inoperable.

A need, therefore, exists to improve upon the prior art pneumatic operated devices. Such an improvement should simplify the manufacturing by eliminating the need for complicated mechanisms and eliminate tubes or channels leading to and from the individual components. Such an improvement will further provide for a pneumatic power supply that is smaller, lighter, compact, and less expensive than other prior art motors.

In addition, most non-tethered pneumatic devices use plastic bottles (or even metal) for the reservoir to which the pneumatic mote is in someway attached thereto. A bottle is typically used because the shape of a typical bottle holds pressurized fluid the best. The bottle combined with the fact that the motor is externally attached is one reason that pneumatic products have to be larger than need be and more importantly, the bottle size and shape can have an effect on the styling of the item, if the item is to be as small as it can possible be. It is therefore a further improvement to have a pneumatic motor attached within the reservoir, which permits a motor output shaft can extend out of the reservoir at any desired location as opposed to hanging off the end of a bottle.

In addition, the size of the product will be dependent upon all of the parts. A benefit realized by the present invention is that size could be minimized while maximizing the use of the space, allowing pneumatic operated devices to be extremely small because of the simplicity of the invention. However, on the other extreme, because of the simplicity of the invention it is also extremely easy to make a pneumatic power supply, in accordance with the embodiments herein, larger. As such, the present invention finds applicability in full size compressed fluid-powered engines, such as described by U.S. Pat. No. 6,006,519. It being further understood that the duration of the operation of the motor is dependent on the size of the motor and the size of the reservoir. Therefore, to maximize duration in any pneumatically operated device it becomes necessary to have the shape of the reservoir conform to the shape of the device; bottles however, do not provide such conformity. In some embodiments of the present invention, the pneumatic motor is integrated and secured entirely within the reservoir further reducing product design limitations.

SUMMARY OF THE INVENTION

In accordance with the present invention there is provided a rechargeable pneumatic power supply. The power supply includes in a first embodiment a refillable chamber capable for holding a pressurized fluid. The chamber includes a vent, an outlet, and an inlet for the receipt and pressurization of a fluid. The power supply also includes a means to relieve excessive pressure within the refillable chamber via the vent. The pressure relieving means is also disposed entirely within the refillable chamber; as such, additional space reserved by a pneumatically operated device to accommodate the pressure relieving means is not needed. The power supply includes a means to release the fluid within the refillable chamber via the outlet. The fluid releasing means is also disposed within the refillable chamber. This eliminates the need for any inlet tubes or outlet tubes connecting the chamber to the pressure releasing means or the fluid releasing means. The inlet, as defined by the first embodiment, permits the connection to an external pump, which may be used to refill the chamber with a fluid (liquid or gas), and permits the fluid to be pressurized. The fluid releasing means preferably includes a controlled opening that when pressed, allows the fluid inside the chamber to exit. An external pneumatic motor may be attached to the fluid releasing means such that when the fluid is released the pneumatic motor utilizes the fluid to drive a pneumatic operated device.

In a second embodiment of the present invention, the chamber also accommodates an on-board pump. The pump is movable relative to the chamber such that when a user extends the pump outwardly away from the chamber and pushes the pump inwardly towards the chamber the user forces air into and pressurizes the air inside the chamber. As such, the present invention advances the art of portable pneumatic products, as a separately and attachable pump is no longer required.

In a third embodiment of the present invention, the chamber includes a pneumatic motor secured within the chamber and directly in communication with the interior of the chamber. The inlet manifold of the pneumatic motor is therefore in communication with the pressurized fluid within the chamber, eliminating the need for a complicated inlet manifold or tubes and pipes leading from a reservoir to an inlet manifold of the pneumatic motor. In addition, since the pneumatic motor is internal to the chamber, size constraints are reduced significantly, as space is no longer needed to accommodate a pneumatic motor separately from the chamber. The pneumatic motor drives an axle that has two ends extending transversely out of the chamber or in a fourth embodiment the axle has a single end extending out of chamber about a rear centerline of the chamber.

In each embodiment, the chamber includes a pressure relieving means that is entirely disposed within and secured to the chamber. The pressure relieving means is also in communication with the interior of the chamber as well as with a vent to allow the fluid within the chamber to vent to atmosphere when the pressure inside the chamber becomes greater than a predetermined optimum pressure set by the pressure relieving means. Greater detail is provided for the pressure relieving means, in the detailed description, as it finds further applicability for any pressurized chamber or reservoir.

It may further be provided, that various concepts provided by each of the embodiments may be employed separately or together to define new embodiments, which are also intended to be covered by the present invention. Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
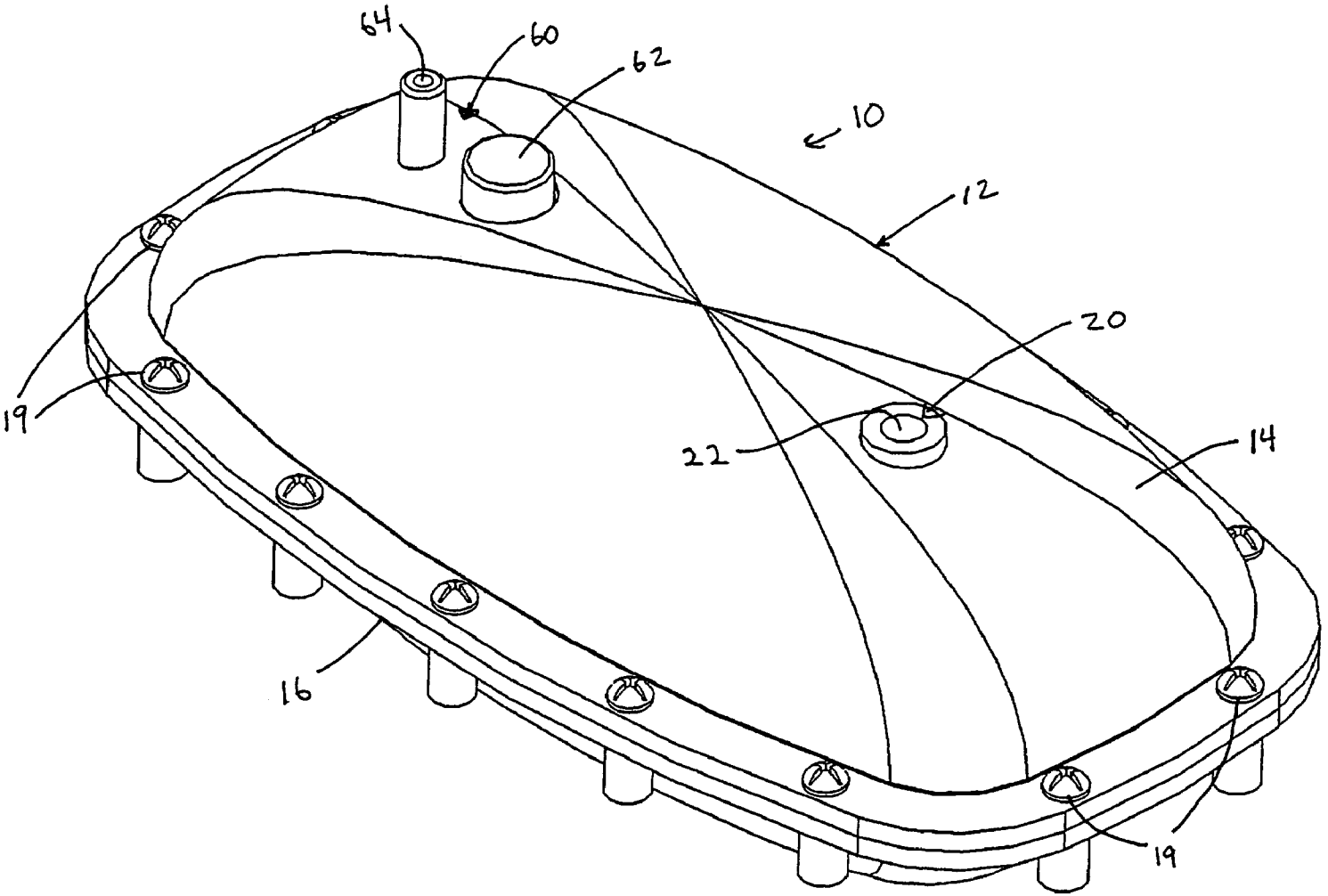
FIG. 1 is a perspective view of a first embodiment of the present invention illustrating a rechargeable pneumatic sub-assembly having a controlled opening to expel fluid to an external pneumatic motor, which is used to operate a pneumatically operated device.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

As mentioned above, the present invention relates to pneumatically operated devices and is used in a wide variety of applications. A pneumatically operated device utilizes a compressed fluid to operate a pneumatic motor or mechanism that drives or operates the device. While some devices are tethered to an external source of compressed fluid, other devices include an on-board refillable reservoir that the user may refill with compressed fluid. The means to continuously refill the reservoir with compressed fluid may be accomplished by a manual pump or automatically by a mechanical pump. These pneumatically operated devices therefore include a "pneumatic power supply" that is defined herein as including a chamber that is in communication with a pneumatic motor. Moreover, in some embodiments of the present invention a "pneumatic power supply sub-assembly" is shown and is defined herein as a chamber that is to be in communication with a pneumatic motor. These definitions will become clearer in view of the drawings and further explanations below.

Figure 2:
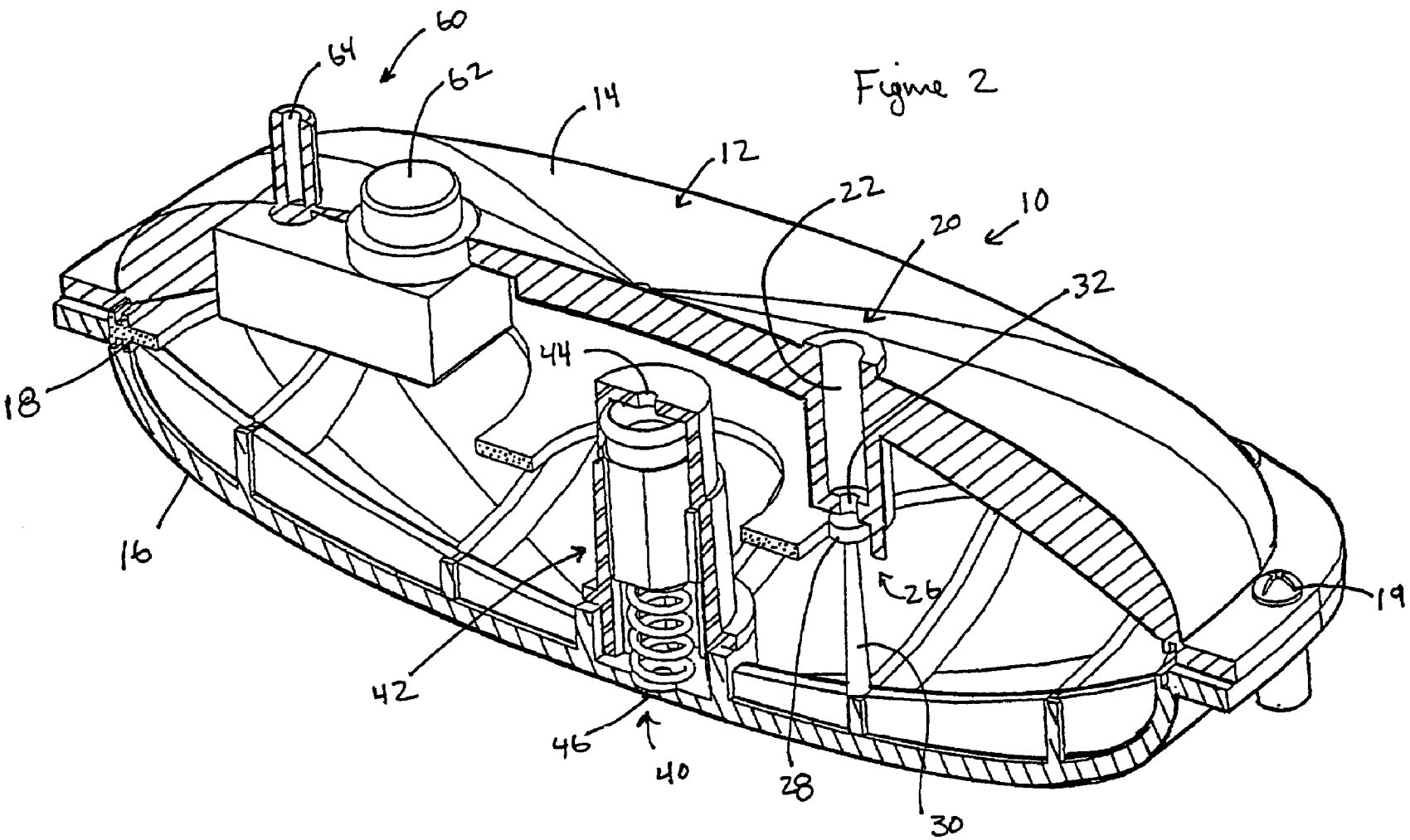
FIG. 2 is a cross-sectional perspective view of the sub-assembly from FIG. 1.

Referring now to FIGS. 1 and 2, a pneumatic power supply sub-assembly 10 is illustrated. The sub-assembly 10 includes a chamber 12 to hold or contain a pressurized fluid. The shape of the chamber 12 is not important to the present invention but may be predefined for a specific pneumatic operated device or space requirements. In addition, as discussed above, the size of the chamber 12 may be made extremely small or large depending upon the application or use of the sub-assembly 10. For exemplary purposes only, if the sub-assembly was to be used to operate a toy car or plane, the size of the chamber 12 may be extremely small. However, if the sub-assembly was to operate a full size car, the size of the chamber 12 may be larger to generate the requisite pneumatic power to operate a full size car.

The chamber 12 is preferably a two-piece housing, 14 and 16 respectively, that is pneumatically sealed together. The two-piece, preferably injected molded, chamber allows pneumatically operated devices to take on any styling and still be the most efficient use of space provided by the pneumatically operated device. Therefore, the largest possible air chamber can be provided while the styling of the pneumatically operated device is maintained.

A seal 18 is positioned between the two houses 14 and 16, and the two houses are secured to each other by a plurality of screws 19. However, any type of fastenings may be used, even adhesives. The chamber 12 includes a means for receiving a fluid 20, a means for relieve pressure 40, and a controlled expelling means 60 for controlling the release of fluid within the chamber.

Figure 3:
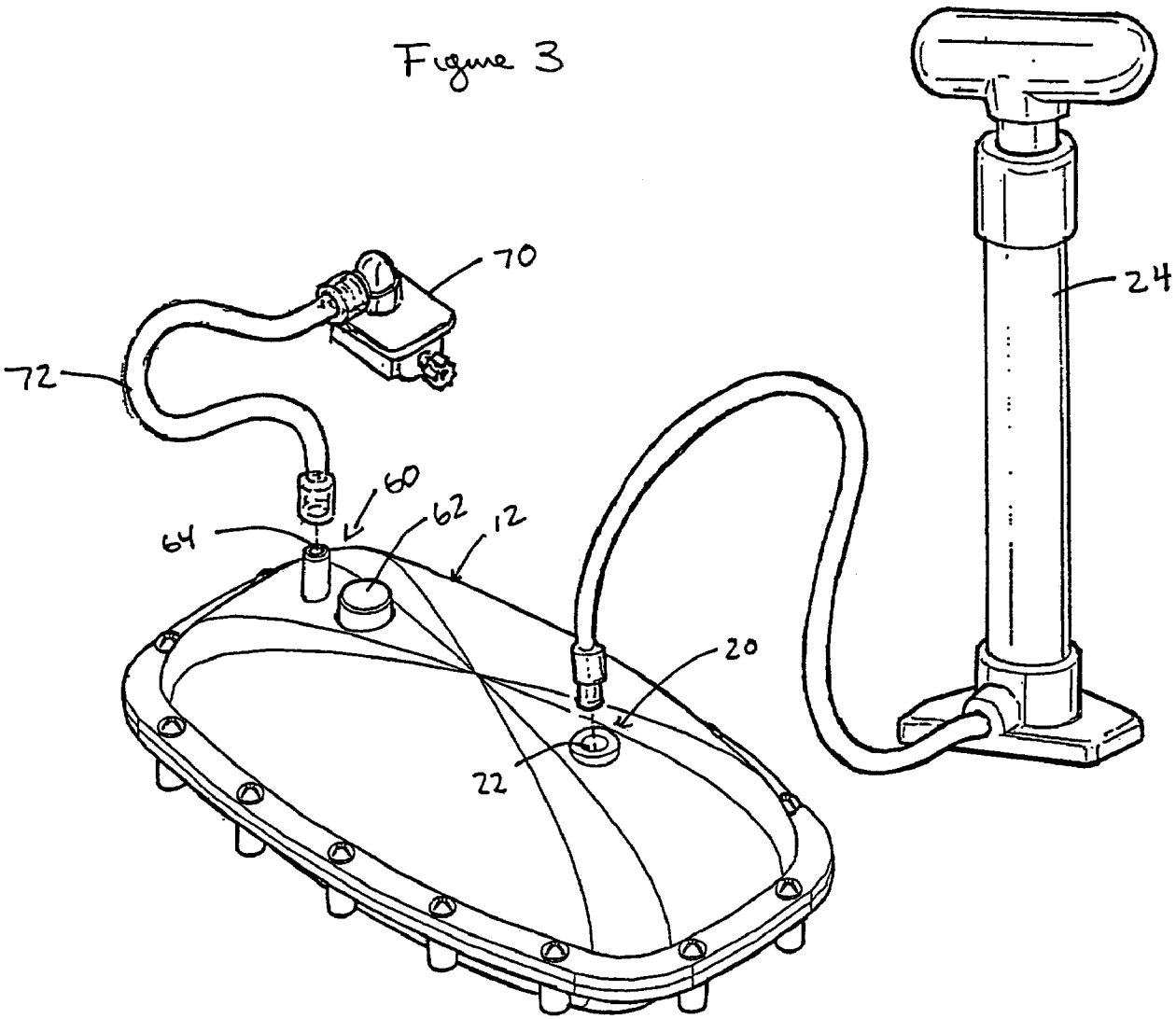
FIG. 3 is a perspective view of the sub-assembly from FIG. 1 further illustrating an external manual pump that is used to fill and recharge the sub-assembly and illustrating an external pneumatic motor that is attached to the controlled opening.

Also referring to FIG. 3, the fluid receiving means 20 is defined as an inlet opening 22 in one of the housings (preferably housing 14). The inlet opening 22 is in communication with the interior of the chamber 12, which allows a user to attach an external pump 24 thereto to pump a fluid (such as air) into the chamber 12. Furthermore, continuous pumping will cause the fluid inside the chamber 12 to pressurize. However, a continuous supply of pressurized fluid, such as an external tank, may also be attached to the inlet opening 22. The fluid receiving means 20 further includes a sealing means 26 that closes the inlet opening 22 from the interior of the chamber 12, such that fluid within the chamber 12 is prevented from exiting the chamber 12. Referring again to FIG. 2, the sealing means 26 is defined as a flexible flap 28 that is held against an inlet aperture 32 defined on the inlet opening 22 and which is in communication with the interior of the chamber 12. A member 30 extends internally from the other one of the two-piece housings (preferably housing 16) towards the inlet aperture 32 and holds the flexible flap 28 against the inlet aperture 32.

In operation, as a fluid enters the inlet opening 22 it pushes and bends the flexible flap 28 to permit the fluid to enter the chamber 12, while the member 30 maintains the relative position of the flexible flap 28 in relation to the inlet aperture 32. The fluid entering the chamber 12 may be pre-pressurized or may pressurize inside the chamber 12 when using a pumping means as already described. When the fluid inside the inlet opening 22 recedes, the fluid inside the chamber 12 will push against the flexible flap 28 in an attempt to exit the chamber 12 (as the pressure outside the chamber is lower than the pressure inside the chamber). The flexible flap 28 will then push and seal against the inlet aperture 32, closing off the inlet opening 22 such that fluid within the chamber 12 is prohibited from exiting the chamber 12. While other types of one-way valves (known in the prior art) may be used, the present fluid receiving means 20 simplifies the process.

The means for relieving pressure 40 is defined as a pressure relieve valve 42 that is disposed entirely within the chamber 12. While pressure relieve valves are typically placed outside of the chamber or reservoir, the pressure relieve valve 42 in the present invention is placed entirely within the chamber 12 itself. This reduces the amount of space the power supply sub-assembly needs to reserve in order accommodate for a pressure relieve valve placed outside the chamber, as well as accommodations for tubes connecting the two together. The pressure relieve valve 42 in accordance with the present invention includes an aperture 44 that is in communication with the interior of the chamber 12; and also includes a vent 46 that is in communication with the atmosphere to vent excessive pressure. The pressure relieve valve 42 is discussed in further detail below in reference to FIGS. 11–12. In operation, as the fluid within the chamber becomes pressurized, the pressurized fluid enters the aperture 44 and pushes against the pressure relieve valve 42. When the pressure of the fluid inside the chamber 12 becomes greater than a pre-determined optimum pressure set by the pressure relieve valve 42, the pressure relieve valve 42 opens allowing the excessive pressure to vent through the vent 46.

Referring again to FIG. 3, the controlled expelling means 60 is entirely disposed within the chamber 12 and is preferred when a pneumatic motor 70 is removably in communication with the chamber 12 or remotely in communication with the chamber 12. As illustrated in FIG. 3, the pneumatic motor 70 is externally attached to the controlled expelling means 60 by a tube 72. It is therefore conceivable that if the pneumatic motor 70 operated a specific pneumatic operated device, that the tube 72 could be removed and replaced with a second tube that connected a different pneumatic motor, which operated a different pneumatic device. The chamber 12 may also include multiple releasing means each connected to a different pneumatic operated device.

The controlled expelling means 60 includes an aperture (not shown) in communication with the interior of the chamber 12 in order to allow the pressurized fluid to enter the controlled expelling means 60. A button 62, operable externally to the chamber 12, permits a user to mechanically open the controlled expelling means 60, which is normally in a closed position. When opened, the controlled expelling means 60 permits the pressurized fluid in the chamber 12 to exit through an outlet 64. The controlled expelling means 60 may be any well-known mechanical valve that is opened by pressing a button, as described above. The controlled expelling means 60 may toggle between the opened and closed position each time the button is pressed or may remain in one position as long as it is pressed.

Figure 4:
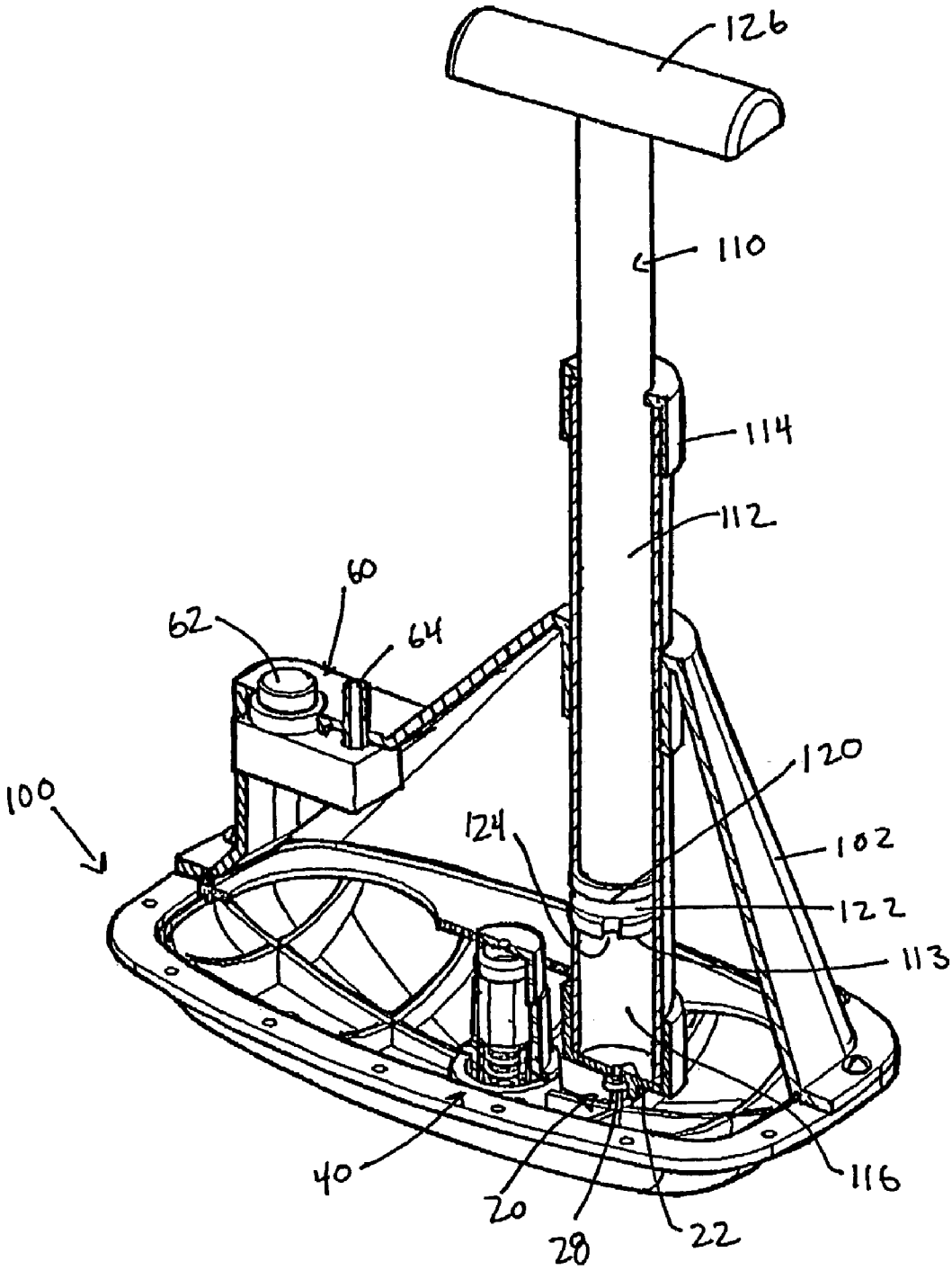
FIG. 4 is a partial cross-sectional view of a second embodiment of the present invention illustrating a sub-assembly that includes an on-board pump.

Referring now to FIG. 4, in a second embodiment of the present invention a sub-assembly 100 (similar to the first embodiment) includes a means for receiving a fluid 20, a means for relieving pressure 40, and a controlled expelling means 60. However, the sub-assembly in accordance with the second embodiment includes a pump 110 that is integrated into the fluid receiving means 20 and movable in relation to the chamber 102. The ability to facilitate an integrated pump into the sub-assembly further provides for a more portable and non-tethered pneumatically operated device as a separate and attachable pump is no longer needed.

The pump 110 includes an elongated piston 112 that slides within a cylinder 114. The end 113 of the piston 112 includes a grove 120 that receives a seal 122 and has notches 124 traversing the groove 120. While the piston 112 is being pulled away from the chamber 102, the seal 122 moves allowing air to seep through the notches 124 and enter a region 116 of the cylinder 114 defined between the end 113 of the piston 112 and the fluid receiving means 20 (and more specifically the inlet opening 22 of the fluid receiving means 20). Subsequently, when pushed into the cylinder 114, the seal 122 moves against the notches 124 preventing air from escaping the region 116. As such, when the piston 112 is pushed towards the chamber 102, air in the region 116 will be pushed through the inlet opening 22, around the flexible flap 28, and into the chamber 102. Repeatedly pumping air into the chamber 102 will pressurize the fluid contained therein. The pump 110 also preferably includes a handle 126 for a user to grasp when pumping a fluid into and pressurizing the fluid inside the chamber 102.

Figure 5:
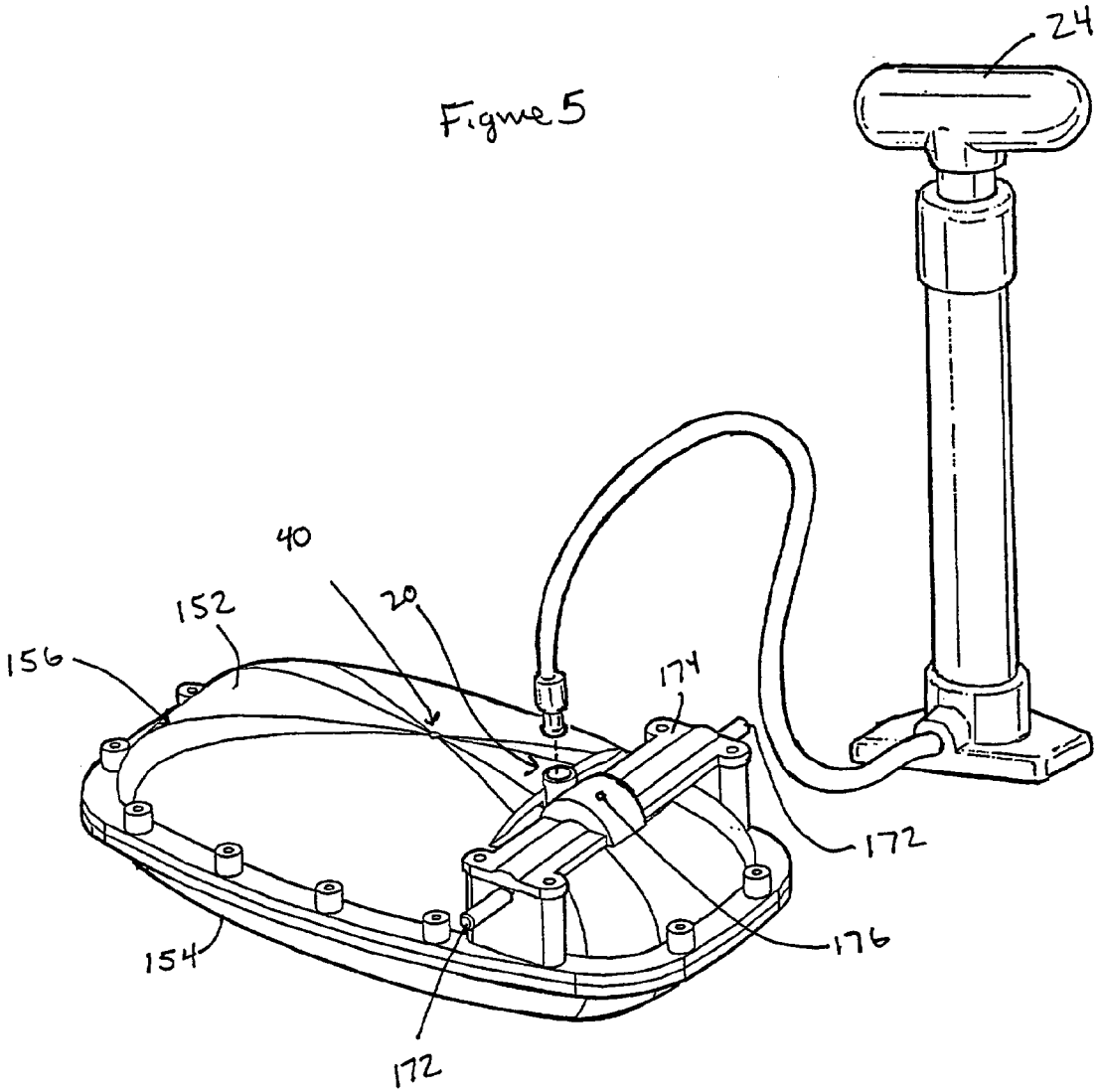
FIG. 5 is a perspective view of a third embodiment of the present invention showing a pneumatic power supply assembly that incorporates a pneumatic engine within a chamber and further illustrates an external pump which is used to recharge the power supply assembly.
Figure 6:
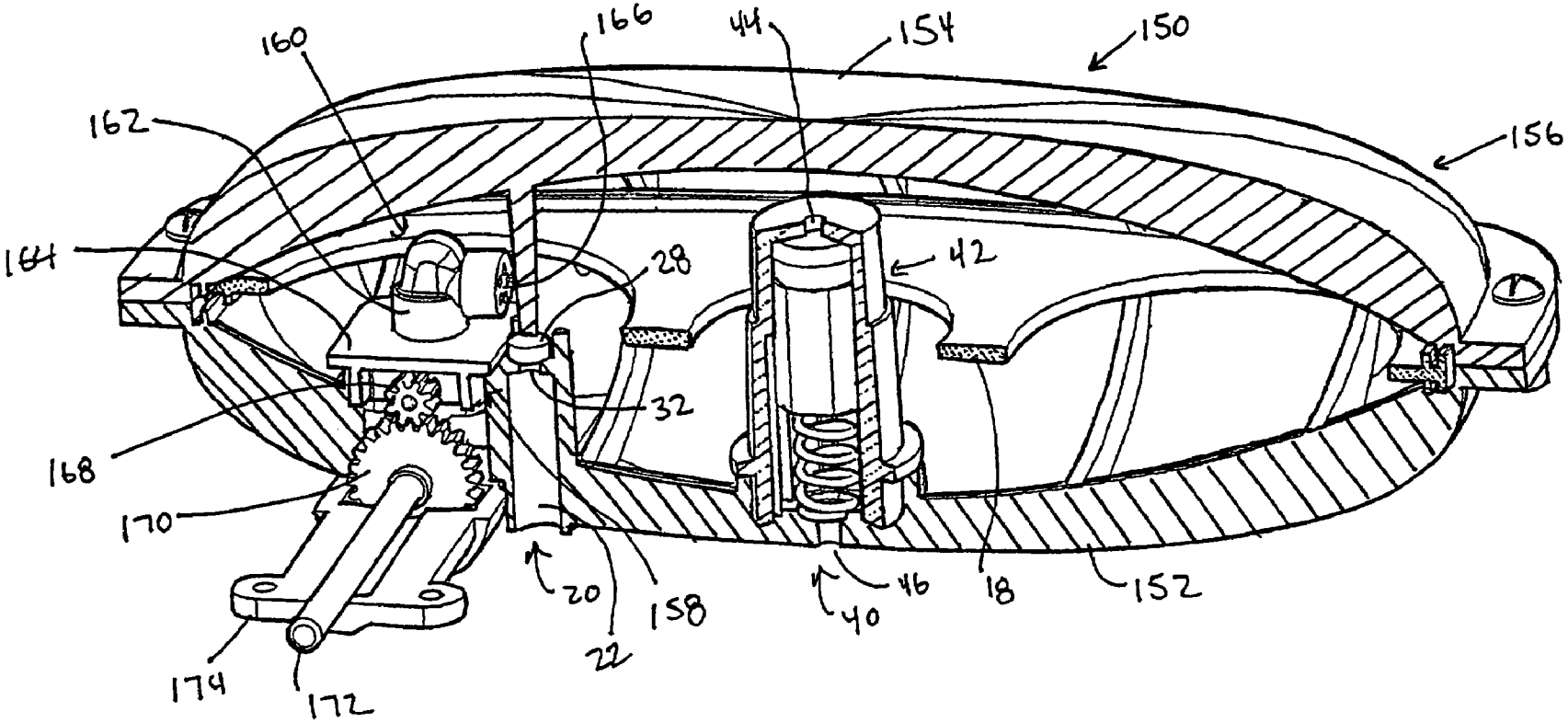
FIG. 6 is a perspective cross-sectional view of the pneumatic power supply assembly shown in FIG. 5.
Figure 7:
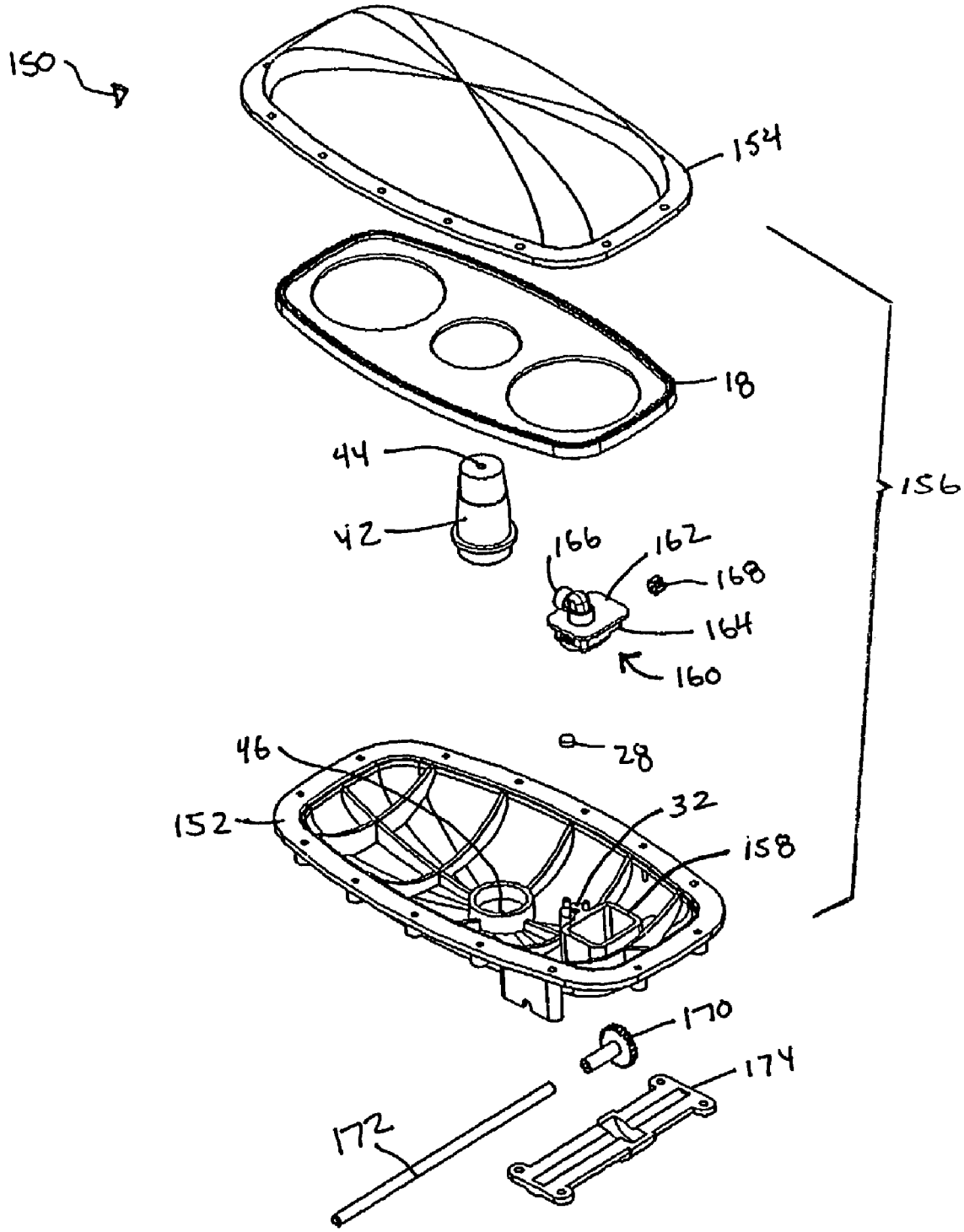
FIG. 7 is an exploded view of the pneumatic power supply assembly from FIG. 5.

Referring now to FIGS. 5 through 7, in a third embodiment of the present invention a pneumatic power supply assembly 150 includes a first housing 152 and a second housing 154 that when assembled forms a chamber 156. The chamber 156 also defines a means for receiving a fluid 20 and a means for relieving pressure 40, both of which are similarly defined above.

The first housing 152 includes a motor receptacle 158 that is designed to accommodate a pneumatic motor 160 and which includes an opening (not shown) through the first housing 152. The pneumatic motor 160 includes a motor housing 162 that defines a plug 164 that frictionally fits into the motor receptacle 158 to create a seal between the interior of the chamber 156 and the opening through the first housing 152. The pneumatic motor 160 also includes a fluid inlet 166 that is defined on the upper portion of the pneumatic motor 160. When the pneumatic motor 160 is placed in the motor receptacle 158, the fluid inlet 166 is directly in communication with the interior of the chamber 156. Below the plug 164, in the opening, the pneumatic motor 160 includes a motor gear 168 that is exposed to the exterior of the chamber 156. The motor gear 168, which is rotated by the pneumatic motor, drives an axle gear 170 and axle 172. A housing plate 174 is attached to the first housing 152 below the motor receptacle 158 to secure the axle and axle gear in place and cover the opening.

The pneumatic motor 160 in operation draws pressurized fluid from the interior of the chamber 156 through the fluid inlet 166 to drive the motor gear 168. The pressurized fluid used by the pneumatic motor 160 is vented by the pneumatic motor 160 below the plug through the motor receptacle 158 and allowed to vent through a motor vent 176 in the housing plate 174. The pneumatic motor 160 may start automatically when the chamber 156 includes pressurized fluid or may require manual initiation that once started will continue to run until the pressurized fluid inside the chamber is no longer capable of running the pneumatic motor 160. To refill and recharge the chamber 156 of the pneumatic power supply assembly 150, an external pump 24 is attached to the means for receiving a fluid 20.

One of the benefits realized by the present invention is that the pneumatic power supply assembly 150 can be utilized in a variety of ways to operate numerous pneumatic operated devices. Without having to continually change the shape of the chamber to accommodate for different devices. For exemplary purposes only, the pneumatic power supply assembly 150 as defined by the third embodiment may be simply secured to a pre-built chassis 180, illustrated in FIG. 8. The same pneumatic power supply assembly 150 could easily be removed and used in a different pneumatic operated device without having to disassembly the entire power supply assembly, which would be required in prior art power supply assemblies.

Figure 8:
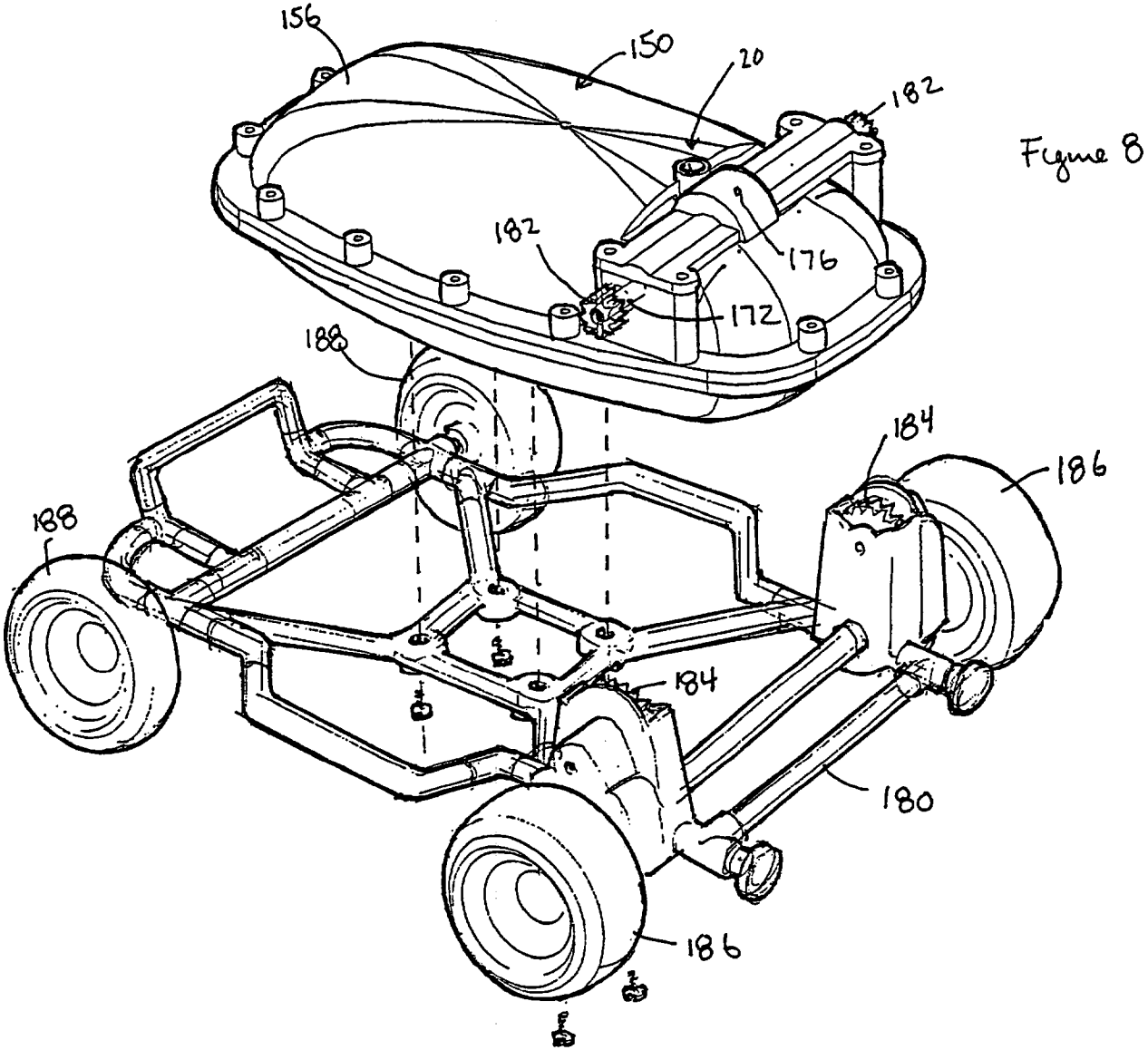
FIG. 8 is a perspective view of the pneumatic power supply assembly shown in FIG. 5 being attached to a chassis that incorporates a pair of tire gears that mesh with a pair of assembly gears when the power supply assembly is attached to the chassis, wherein when the power supply assembly is charged and rotates the assembly gears, the pair of tires secured to the tire gears on the chassis rotate.

Continuing to refer to FIG. 8, the axle 172 extends out of the chamber 156 and drives a pair of gears 182, which mesh with chassis gears 184 to rotate a first pair of wheels 186. The chassis 180 includes a second pair of wheels 188 that rotate freely. It is further contemplated from the present invention that the chamber 156 may include multiple pneumatic motors integrated into the interior of the chamber 156 such that a second axle may extend out of the chamber to rotate the second pair of wheels 188. In addition, since each pneumatic motor runs from the same chamber, problems associated with pressurizing multiple chambers equally to achieve similar power rates from each pneumatic motor is eliminated.

The pneumatic power supply assembly 150 may also include a separate controlled expelling means, as it may be desired to removably attach a second pneumatic motor thereto. This would thereby allow the pneumatic power supply assembly 150 to operate more than one pneumatic operated device at a time or switch between devices.

Figure 9:
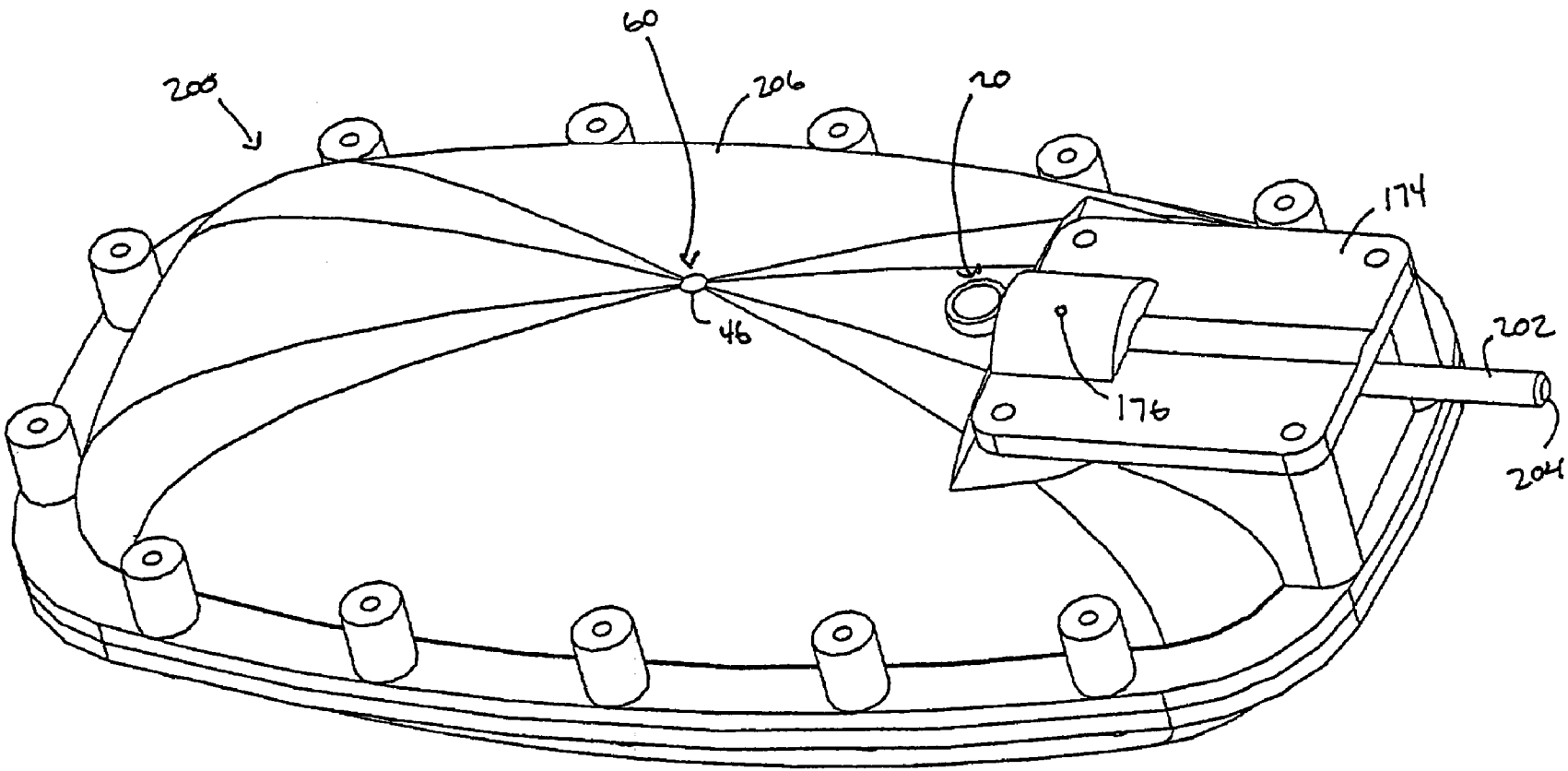
FIG. 9 is a perspective view of a fourth embodiment of the present invention showing a pneumatic power supply assembly that incorporates a pneumatic engine within a chamber and includes a single drive axle extending out of the rear centerline of the chamber.
Figure 10:
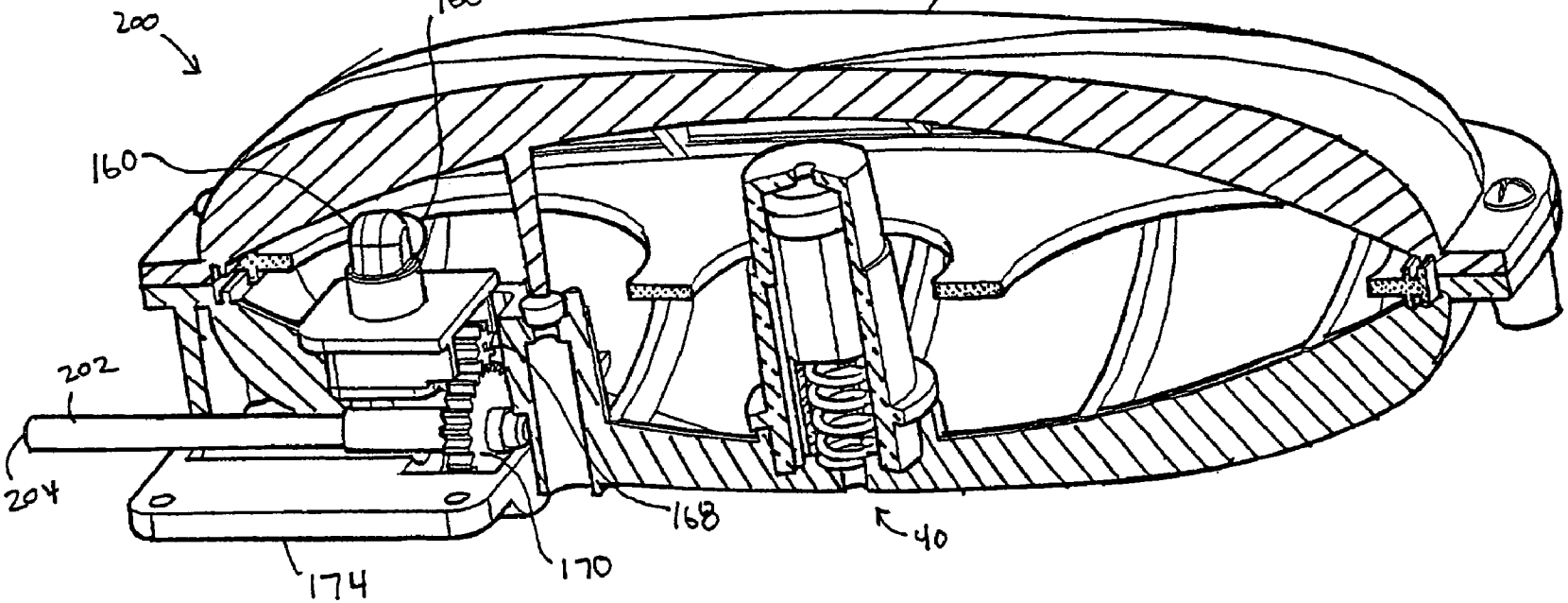
FIG. 10 is a cross-sectional view of the power supply shown in FIG. 9.

Referring now to FIGS. 9 and 10, in a fourth embodiment of the present invention a pneumatic power supply assembly 200 similarly configured to the pneumatic power supply assembly 150 in the third embodiment is illustrated. However, the pneumatic power supply assembly 200 (in the fourth embodiment) includes a centerline drive axle 202, which has only one end 204 extending out of the chamber 206. As shown more clearly from the cross-sectional view FIG. 10, the pneumatic motor 160 has a fluid inlet 166, directly in communication with the interior of the chamber 206. The pneumatic motor 160 drives a motor gear 168 that is exposed to the exterior of the chamber 206. The motor gear 168 is meshed to an axle gear 170 that is secured to and drives the drive axle 202.

Figures 11A, 11B, 12:
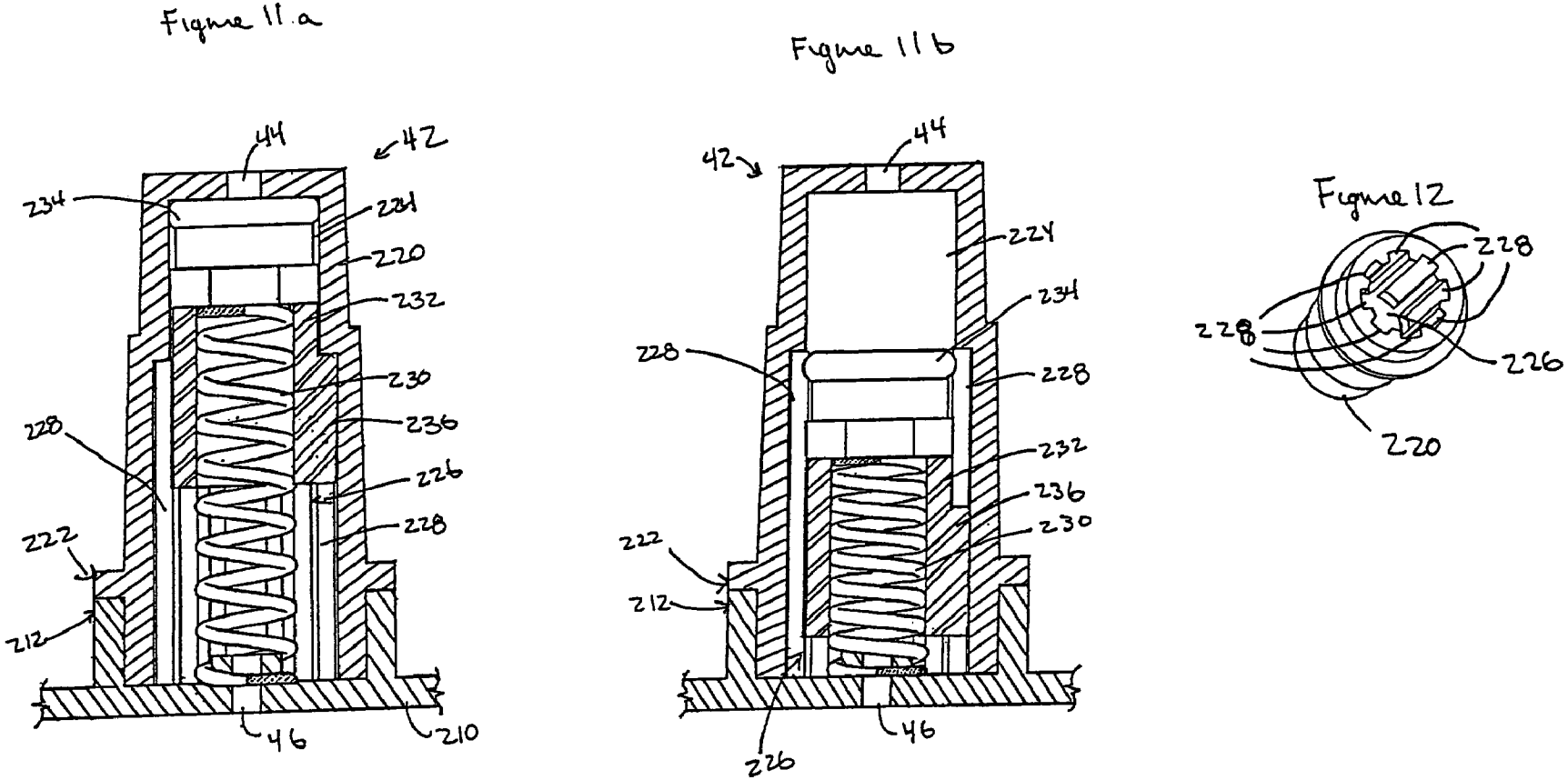
FIG. 11*a* is a cross-sectional view of the pressure relieve valve while the pressure relieve valve is in a closed position.
FIG. 11*b* is a cross-sectional view of the pressure relieve valve while the pressure relieve valve is in an opened position.
FIG. 12 is a perspective view of a valve housing defined by the pressure relieve valve illustrating channels running on the interior cavity of the bottom portion thereof.

Referring now to FIGS. 11 through 12, as previously mentioned, each chamber includes a means for relieving pressure 40 that is preferably defined as a pressure relieve valve 42 that is entirely disposed within the chamber 210. This reduces the amount of space the pneumatically operated device needs to reserve in order accommodate for a pressure relieve valve placed outside the chamber, as well as eliminate an assembly that attaches the pressure relieve vale to the chamber and the pump to supply fluid. The pressure relieve valve 42 includes a valve housing 220 that is entirely disposed within and secured to the interior of the chamber 210. Preferably, the valve housing 220 includes a base 222 that mounts to a section 212 of the chamber 210 to encompass the vent 46. However, any securing means may be used. The mount, however, does provide a pneumatic seal between interiors of the chamber 210 and the valve housing 220 such that fluid within the chamber 210 is not able to leak under the valve housing 220 and out the vent 46. The valve housing 220 includes an aperture 44, which is open to the interior of the chamber 210. A first interior cavity 224, defined within the valve housing 220, is in communication with the aperture 44 and a second interior cavity 226 that is in communication with the first interior cavity 224 and the vent 46. Running along the walls of the second interior cavity 226 are a plurality of interior channels 228.

The pressure relieve valve 42 also includes a spring 230, a spring sleeve 232, and a resilient sleeve cap 234, all of which is contained within the valve housing 220. The spring 230 is secured on one end to the chamber 210 and on the other end to the spring sleeve 232. The spring 230 has a predetermined compression force that sets the optimum pressure allowed inside the chamber 210. The sleeve cap 234 is secured to the top portion of the spring sleeve 232 and has a diameter that is substantially equal to the first interior cavity 224 such that fluid entering the first interior cavity 224 via the pressure release aperture 44 cannot seep below the sleeve cap 234 and enter the second interior cavity 226. The spring sleeve 232 includes a ridged portion 236 extending outwardly from the spring sleeve 232 and which fits within one of the interior channels 228 defined on the second interior cavity 226 to act as a guide to control the movement of the spring sleeve 232.

As the pressure within the chamber 210 reaches and exceeds the predetermined optimum pressure defined by the compression force preset by the spring 230, the fluid pushing against the sleeve cap 234 will cause the spring 230 to compress, moving the spring sleeve 232 further into the second interior cavity 226. As this continues, the spring sleeve 232 will move until the spring cap 234 enters the second interior cavity 226. When the spring cap 234 enters the second interior cavity 226, the fluid in the first interior cavity 224 will seep around the spring cap 234 and enter the second interior cavity 226 via the channels 228. As the fluid enters the second interior cavity 226, the fluid will be allowed to vent through the pressure release vent 46, relieving the pressure in the chamber 210 below the optimum pressure defined by the spring 230. The spring 230 will then return the spring cap 234 above the second interior cavity 226 sealing off the chamber 210.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A pneumatic power supply sub-assembly comprising:

a refillable chamber capable for holding a pressurized fluid, the chamber includes a vent, an outlet, and an inlet for receipt and pressurization of a fluid;

a means to relieve pressure within the refillable chamber via the vent, when a fluid contained within the chamber obtains a pressure greater then a predetermined optimum pressure, the pressure relieving means disposed entirely within the refillable chamber; and a manual means to release fluid within the refillable chamber via the outlet, the fluid releasing means disposed entirely within the refillable chamber.

2. The sub-assembly of claim 1 further comprising an external pump that is removably attached to the inlet, the pump having the means for pumping a fluid into the refillable chamber to pressurize the fluid inside the refillable chamber.

3. The sub-assembly of claim 1, wherein the fluid releasing means includes an opening in fluid communication with the refillable chamber and is in fluid communication with the outlet, the fluid releasing means further includes a switch, the switch manually operable externally from the refillable chamber by a user such that the user is capable of controlling the release of fluid within the refillable chamber.

4. The sub-assembly of claim 1 further comprising an external pneumatic motor that is used to operate a pneumatically operated device, the external pneumatic motor is externally connected to the outlet such that when the fluid releasing means is manually operated, the pneumatic motor utilizes pressurized fluid within the refillable chamber to operate the pneumatically operated device.

5. The sub-assembly of claim 1, wherein the pressure relieving means is defined by having:

a valve housing disposed entirely within the chamber and mounted to the chamber encompasses the vent, the valve housing having an aperture that is in fluid communication with an interior region of the chamber, the valve housing further including a first interior cavity in fluid communication with the aperture and including a second interior cavity in fluid communication with the first interior cavity and the vent, the second interior cavity having a plurality of channels;

a spring positioned within the valve housing attached between a spring sleeve and the chamber; and a sleeve cap positioned above the spring sleeve and having a size substantially equal to the first interior cavity to prevent fluid in the first interior cavity from entering the second interior cavity, wherein when the pressure of the fluid within the chamber exceeds a predetermined optimum pressure, the fluid compresses the spring until the sleeve cap moves into the second interior cavity wherein the fluid vents out of the chamber through the vent via the channels in the second interior cavity.

6. The sub-assembly of claim 1 further comprising a pump that is integrally attached to the inlet and movable in relation to the refillable chamber, the pump having the means for pumping a fluid into the refillable chamber to pressurize the fluid inside the refillable chamber.

7. A pneumatic power supply assembly comprising:

a refillable chamber having an interior capable for holding a pressurized fluid, the chamber having a means for receiving a fluid;

a pneumatic motor disposed within and mounted to the chamber, the pneumatic motor having an inlet in fluid communication with the interior of the chamber and a gear rotated by and attached to said pneumatic motor; and an axle secured to the gear and attached through the chamber such that the axle has an end extending out of said chamber.

8. The pneumatic power supply assembly of claim 7, wherein the means for receiving a fluid further includes an fluid inlet opened to the interior of the chamber, and a flexible flap disposed entirely within the interior of the chamber and held against the inlet such that an external source of fluid is capable of being pumped into the chamber through said inlet, but said fluid is prohibited from exiting the chamber via the inlet.

9. The pneumatic power supply assembly of claim 7, wherein the chamber further comprising a vent, and a means to relieve excessive pressure within the chamber through the vent, said pressure relieving means disposed entirely within the chamber.

10. The sub-assembly of claim 9, wherein the pressure relieving means is defined by having:

a valve housing disposed entirely within the chamber and mounted to the chamber such that the valve housing encompasses the vent, the valve housing having a aperture that is in fluid communication with an interior region of the chamber, the valve housing further including a first interior cavity in fluid communication with the aperture and including a second interior cavity in fluid communication with the first interior cavity and the vent, the second interior cavity having a plurality of channels;

a spring positioned within the valve housing attached between a spring sleeve and the chamber; and a sleeve cap positioned above the spring sleeve and having a size substantially equal to the first interior cavity to prevent fluid in the first interior cavity from entering the second interior cavity, wherein when the pressure of the fluid within the chamber exceeds a predetermined optimum pressure, the fluid compresses the spring until the sleeve cap moves into the second interior cavity to permit fluid to exit the chamber through the vent via the channels in the second interior cavity, whereby the pressure in the chamber is relieved.

11. A pneumatic power supply assembly comprising:

a refillable chamber having an interior capable for holding a pressurized fluid and an inlet for receiving a fluid;

a pneumatic motor having an inlet that is disposed entirely within the chamber such that the inlet is in direct fluid communication with the interior of the chamber, the pneumatic motor to drive a gear rotatably attached to said pneumatic motor; and an axle is rotatably attached through the chamber and secured to the gear such that when the gear is rotated by the pneumatic motor the axle rotates, the axle having a pair of ends extending transversely out of said chamber.

12. The pneumatic power supply assembly of claim 11 further comprising a controlled outlet to expel fluid within the refillable chamber, the controlled outlet disposed within the refillable chamber, the controlled outlet having a switch to control the expulsion of fluid that is operable externally from said chamber.

13. The pneumatic power supply assembly of claim 11 includes a chassis, the chassis includes a pair of tire gears that mesh with a pair of assembly gears secured to the ends of the axle, when the chamber is secured to the chassis, wherein when the power supply assembly is charged with a pressurized fluid, the pneumatic motor rotates the assembly gears causing the tires on the chassis to rotate.

14. The pneumatic power supply assembly of claim 11 wherein the chamber is removably secured to the chassis.

15. The pneumatic power supply assembly of claim 11, wherein the chamber further comprising a vent, and a means to relieve excessive pressure within the chamber through the vent, said pressure relieving means disposed entirely within the chamber.

16. The sub-assembly of claim 15, wherein the pressure relieving means is defined by having:

a valve housing disposed entirely within the chamber and having an aperture that is in fluid communication with an interior region of the chamber, the valve housing further including a plurality of channels in communication with the vent;

a spring positioned within the valve housing attached between a spring sleeve and the chamber; and a sleeve cap positioned above the spring sleeve and having a size substantially equal to the valve housing to prevent fluid from venting, wherein when the pressure of the fluid within the chamber exceeds a predetermined optimum pressure, the fluid moves the sleeve cap until said fluid is capable of venting out of the chamber through the vent via the channels.

17. A pneumatic power supply sub-assembly comprising:

a refillable chamber having an interior capable for holding a pressurized fluid, an inlet for receiving a fluid, and a vent; and a means to relieve excessive pressure within the chamber through the vent, the pressure relieving means disposed entirely within said chamber, and wherein the pressure relieving means includes:

a valve housing disposed entirely within the chamber, the valve housing having an aperture that is in fluid communication with an interior region of the chamber, the valve housing further including a plurality of channels in communication with the vent, a spring positioned within the valve housing and attached between a spring sleeve and the chamber, and a sleeve cap positioned above the spring sleeve and having a size substantially equal to the valve housing to Prevent fluid from venting, wherein when the pressure of the fluid within the chamber exceeds a predetermined optimum pressure, the fluid moves the sleeve cap until said fluid is capable of venting out of the chamber through the vent via the channels.

18. The sub-assembly of claim 17 further comprising an externally controlled opening to release fluid within the refillable chamber via an outlet defined by the chamber, the externally controlled opening secured entirely within the refillable chamber and an external pneumatic motor that is used to operate a pneumatically operated device, the external pneumatic motor is externally connected to the outlet such that when the controlled opening is manually operated, the pneumatic motor utilizes pressurized fluid within the refillable chamber to operate the pneumatically operated device.

* * * * *